United States Patent [19]

Wagner et al.

[11] Patent Number: 4,607,655

[45] Date of Patent: Aug. 26, 1986

[54] SURVIVAL SHELTER

[76] Inventors: David L. R. Wagner, 6410 NE. Willow, Portland, Oreg. 97266; Donald E. Bixler, 205 3rd Ave., Oregon City, Oreg. 97045

[21] Appl. No.: 598,484

[22] Filed: Apr. 9, 1984

[51] Int. Cl.[4] ..... E04H 15/44; E04H 15/30; E02B 1/34; A61G 1/00

[52] U.S. Cl. ..... 135/95; 5/82 R; 52/2; 135/116

[58] Field of Search ..... 135/87, 95, 96, 901, 135/111, 108, 107, 106; 52/2; 5/82 R

[56] References Cited

U.S. PATENT DOCUMENTS

| | | | |
|---|---|---|---|
| 611,829 | 10/1898 | Brown | 5/82 |
| 2,385,067 | 9/1945 | Egardner . | |
| 2,785,695 | 3/1957 | Carey | 52/2 |
| 2,819,724 | 1/1958 | Barker | 52/2 |
| 2,830,606 | 4/1958 | Daugherty | 52/2 |
| 2,875,771 | 3/1959 | Brewin | 52/2 |
| 3,110,912 | 11/1963 | Propst . | |
| 3,145,719 | 8/1964 | Johnson . | |
| 3,227,169 | 1/1966 | Fischer | 135/106 X |
| 3,247,627 | 4/1966 | Bird | 52/2 |
| 3,304,665 | 2/1967 | Lee | 52/2 |
| 3,375,321 | 3/1968 | Laing . | |
| 3,456,403 | 7/1969 | Batterson | 52/2 |
| 3,457,684 | 7/1969 | Wood, Jr. | 52/2 |
| 3,840,919 | 10/1974 | Middleton . | |
| 3,879,775 | 4/1975 | Iwata . | |
| 3,986,505 | 10/1976 | Power | 5/82 R |
| 4,000,585 | 1/1977 | Denaro . | |
| 4,000,749 | 1/1977 | Busco . | |
| 4,067,075 | 1/1978 | Leathers et al. | 5/82 R |
| 4,068,418 | 1/1978 | Masse . | |
| 4,124,908 | 11/1978 | Burns et al. . | |
| 4,192,030 | 3/1980 | Casson | 5/420 |
| 4,301,791 | 11/1981 | Franco, III | 5/82 R X |
| 4,335,545 | 6/1982 | Couch | 5/82 R |
| 4,466,145 | 8/1984 | Jones et al. | 5/82 R |
| 4,531,330 | 7/1985 | Phillips | 5/414 X |

FOREIGN PATENT DOCUMENTS

| | | | |
|---|---|---|---|
| 67070 | 12/1982 | European Pat. Off. | 5/81 R |
| 610743 | 5/1979 | Switzerland | 52/2 |

*Primary Examiner*—Robert A. Hafer
*Assistant Examiner*—D. Neal Muir
*Attorney, Agent, or Firm*—Klarquist, Sparkman, Campbell, Leigh & Whinston

[57] ABSTRACT

An inflatable, self-supporting shelter particularly suited for survival use in remote, rugged terrain and evacuating injured victims includes inflatable floor and side panels and two opposing multi-layered, noninflatable end panels which cooperate to form an enclosed shelter. The floor and side panels each include an inner wall, outer wall and plurality of parallel, longitudinally extending strips therebetween. The strips, which are connected to both the inner and outer walls, have an "I" shaped cross section and serve to divide the air space between the walls into a series of pneumatically interconnected cells and to rigidify the shelter when it is inflated. In one embodiment, the shelter is provided with pole receiving means to facilitate transporting the shelter as a litter, and fastening means securing the side panels and end panels to one another such that the shelter can be "opened up" to provide quick and easy access to the victim.

13 Claims, 9 Drawing Figures

SURVIVAL SHELTER

BACKGROUND OF THE INVENTION

The present invention relates to a portable shelter and more particularly to a thermally insulated, collapsible shelter especially suited for emergency use to combat hypothermia and to evacuate injured victims.

There is a strong need for a relatively small, compact emergency shelter for use by one or more survivor(s) of an airplane crash or other catastrophe in isolated, rugged terrain, where exposure to the elements poses a serious problem to the survivor(s). Such survivor(s) may have to survive on their own for up to 48 hours or even longer before rescuers locate the crash site or, once located, have time to reach the site. In the event of a crash, hypothermia or exposure is a serious problem for all concerned, particularly under harsh weather conditions, and is a critical problem for injured survivors suffering from shock or loss of blood. It is essential that the injured survivors, and under many conditions, all survivors, conserve body heat and keep as warm and dry as possible.

A tent or shelter suitable for this purpose must be light, sturdy and compact because most airplane crashes in rugged terrain happen to small, light planes capable of carrying only a few passengers and a small amount of gear and supplies. Obviously, larger commercial planes have the capacity to carry relatively large, elaborate shelters, but such is not the case with small planes. Not only would heavy, bulky emergency shelters be impractical as standard emergency equipment for small planes, but they would be ill-suited for air-drop by helicopter or small rescue plane to crash survivors in rugged terrain.

Ideally, the shelter should be self-supporting, as well as compact, since the crash area may be quite rocky, affording little or no level ground upon which to pitch the shelter. The shelter should be of simple construction and easy to set up, even by mobile injured survivors. It should be sturdy and capable of withstanding heavy snowfall and high winds. Most importantly, the shelter should be virtually waterproof and afford maximum protection from the environment under a wide variety of conditions. Ideally, it would also be desirable to use the shelter to evacuate the injured survivor(s) to safety.

Prior tents and shelters, some of which are designed for emergency use, do not adequately meet the foregoing criteria. Two examples of inflatable tents are shown in U.S. Pat. No. 4,000,585 to Denaro and U.S. Pat. No. 3,457,684 to Wood. The Denaro tent is not self-supporting without its internal frame which adds weight to the tent and complexity to its assembly, making it ill-suited as a survival shelter in rugged, remote areas.

Although the tent shown in Wood does not require an internal frame, it shares another important shortcoming with the Denaro tent. Both are of the "camping tent" type and ill-suited for emergency survival use because they are not adequately thermally insulated. Although both tents have panels formed of inflatable tubular cells, a significant amount of heat is lost at the seams between such cells and at the adjoining edges of such panels, where no insulation, air or otherwise, exists between the tent's inner and outer surfaces. In the case of the Wood tent, the end panels are also not insulated. Without a sleeping bag or blankets, it is unlikely that a crash survivor, particularly an injured one, could survive in these tents under adverse conditions for very long.

Two tents ostensibly designed for emergency use are shown in U.S. Pat. Nos. 2,830,606 and 2,819,724 to Daugherty and Barker, respectively. The Daugherty tent, like the Denaro and Wood tents, suffers significant heat loss at the seams between its tubular air chambers, as well as at its end panels which are not insulated. With this tent, survival under harsh conditions is questionable. Equally important, its seams, as well as the seams of the Denaro and Wood tents, are prone to allowing moisture into the tent when they are exposed to continuous rain or other forms of moisture. This is a very common problem with camping type tents, even when a rain fly is used. This problem has potentially dangerous consequences when the weather conditions are severe because a wet victim is much more prone to suffer from hypothermia than one who is dry.

The Barker tent, which is designed for use in Arctic regions, appears to be the only prior shelter having a true "double-wall" construction that alleviates the heat loss problem caused by the "seams" of the foregoing tents. Although this tent is quite large and evidentally designed to shelter several people comfortably, it does have a few of the desired characteristics for a small survival shelter suited for use under severe conditions. It appears to provide a frameless shelter with a high degree of thermal insulation. It also appears to be fairly easy to set-up.

However, aside from the difficulty of using a large tent of this type in rugged mountainous terrain common to Western parts of the United States, this tent does not appear to be adequately supported to withstand heavy snowfall or snowpack which could possibly bury the tent. The inner and outer walls of the tent, which form an air pocket therebetween, are connected by thin threads which provide little, if any, structural support for the tent. The sole supporting means for the tent is the air pressure supporting the walls when the tent is inflated. Consequently, it is quite likely that high winds or heavy snow accumulation on the top of the tent would cause the tent to deform, if not buckle altogether. As a further disadvantage, the Barker tent lacks suitable means for efficiently controlling the amount of heat lost to the environment, a feature desirable in less severe conditions where the tent could become uncomfortably warm because it is so well insulated. This obviously would not be a problem with the other tents discussed because of their relatively poor insulating traits.

None of the foregoing tents are suited for use in evacuating to safety an injured victim who should remain as immobile as possible. Typically, the victim(s) of an airplane crash in rugged terrain will have to be evacuated to an area accessible to a vehicle or helicopter. With all of the foregoing tents, the victim would have to be removed from the tent before being evacuated.

Of slight relevance in this regard are U.S. Pat. Nos. 3,986,505, 4,124,908 and 4,301,791 to Power, Burns, et al. and Franco, respectively, which all show litter-type devices for transporting injured victims. All three such litters have one or more covers which envelope the victim to help keep the victim warm. In the case of Power and Burns, two overlapping covers are secured in place by Velcro-type fasteners. The Franco litter supports the victim on an inflatable bed. None of these devices are suited for use as a shelter in adverse weather conditions.

Accordingly, there is a need for a small emergency shelter suited for use in rugged terrain under severe weather conditions that is light, portable, easy to set-up and stands up to high winds and heavy snowfall without buckling.

A primary object of the invention is to provide a collapsible emergency shelter suited for use in rugged terrain under all types of weather conditions that stands up to high winds and heavy snow conditions without buckling.

A second object of the present invention is to provide shelter, as aforesaid, that has a high degree of insulation against heat loss and is virtually waterproof.

A further object of the invention is to provide a shelter, as aforesaid, that is light, portable and easy to set-up.

Yet another object of the invention is to provide a shelter, as aforesaid, that is entirely self-supporting without a frame, poles, stakes or the like.

Still another object of the present invention is to provide a shelter, as aforesaid, with means for effectively controlling the amount of heat loss from the shelter.

Another object of the present invention is to provide a shelter suitable for evacuating safely an injured victim and affording medical personnel quick access to the victim while the victim remains immobile.

Other objects will become apparent from the following detailed description of a preferred embodiment and the drawings.

SUMMARY OF THE INVENTION

In accordance with the foregoing objects, the present invention comprises an inflatable shelter including opposed end panels, inflatable floor and inflatable side portions which together cooperate to form an enclosed self-supporting shelter. The floor and side portions each have an outer wall, inner wall and plurality of continuous strips therebetween connected to both the inner and outer walls. The strips preferably extend virtually the full length of such walls to divide the space between the walls into a plurality of pneumatically interconnected chambers. When the tent is inflated, the chambers fill with air which acts as a thermal insulator to effectively minimize heat loss from the enclosed shelter to the environment. In a preferred form, the end panels comprise a multi-layered, non-inflatable insulation material, and the strips have a substantially I-shaped cross section with a web portion extending substantially perpendicularly to the inner and outer walls when the shelter is inflated. In an alternate embodiment of the invention, the shelter is provided with pole receiving means enabling the shelter to be transported as a litter, and mating fastening means along adjoining edges of the end panels and side panels to permit the shelter to be quickly and easily "opened up" so as to provide access to an injured person inside the shelter.

I

Figure 2:
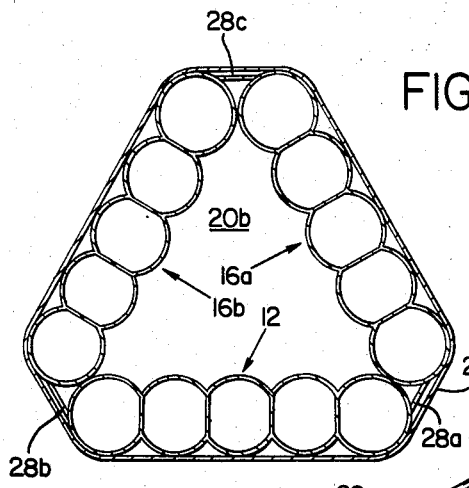
Figure 1:
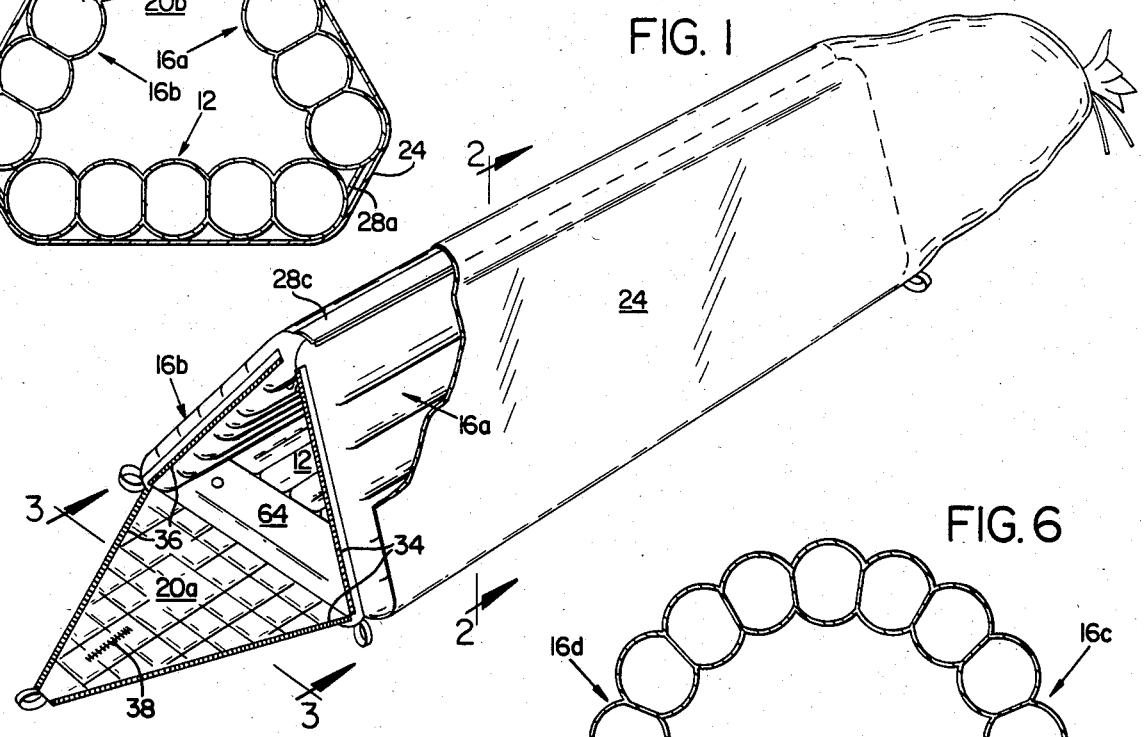
FIG. 1 is a perspective view of a survival shelter in accordance with the present invention.

FIG. 2 is a sectional view taken along line 2—2 of FIG. 1, on an enlarged scale.

Figure 3:
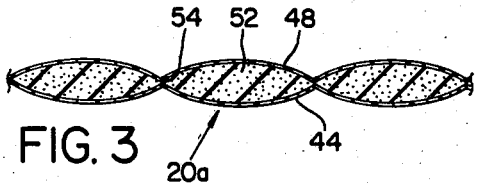

FIG. 3 is a sectional view taken along line 3—3 of FIG. 1, on an enlarged scale.

Figure 4:
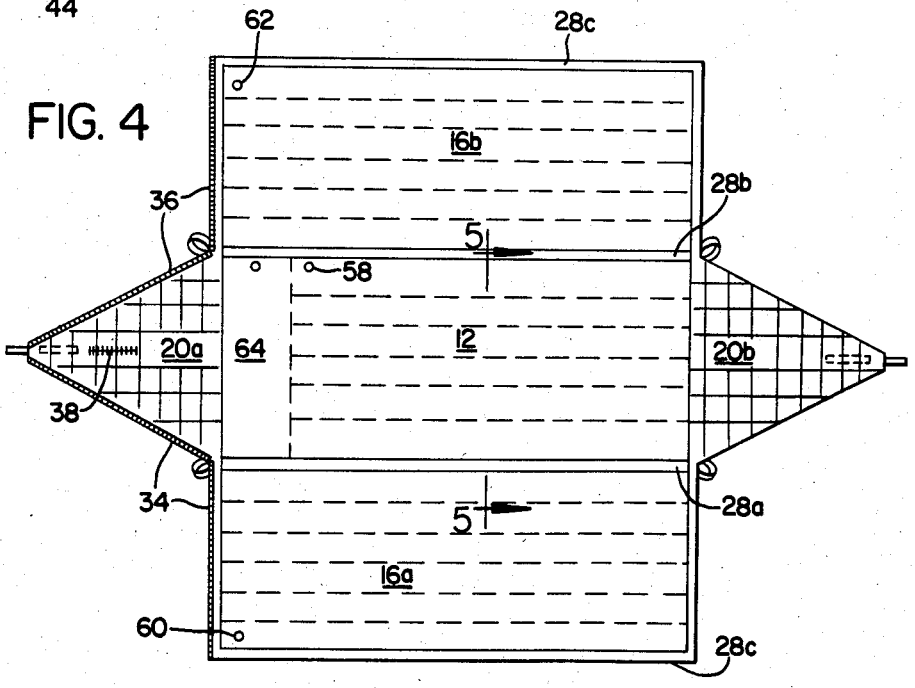

FIG. 4 is a plan view showing the shelter in a splayed condition, on a reduced scale, for purposes of illustration.

Figure 5:
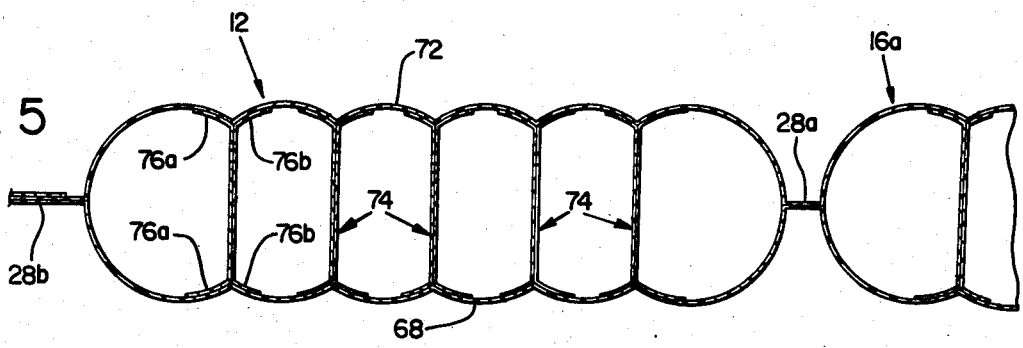

FIG. 5 is a sectional view taken along line 5—5 of FIG. 4, on an enlarged scale.

Figure 6:
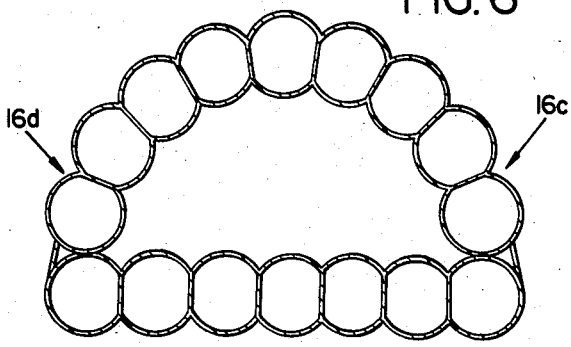

FIG. 6 is a view similar to that of FIG. 2 showing an alternate embodiment without separate side panels.

Figure 7:
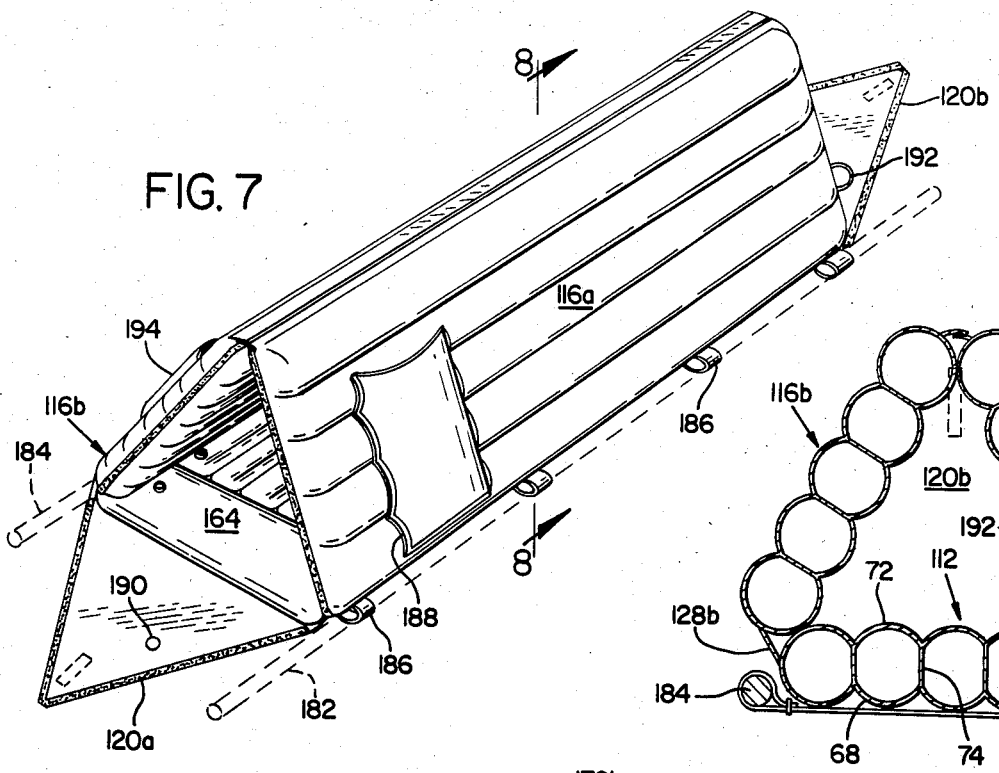

FIG. 7 is a perspective view of an alternate embodiment of the present invention.

Figure 8:
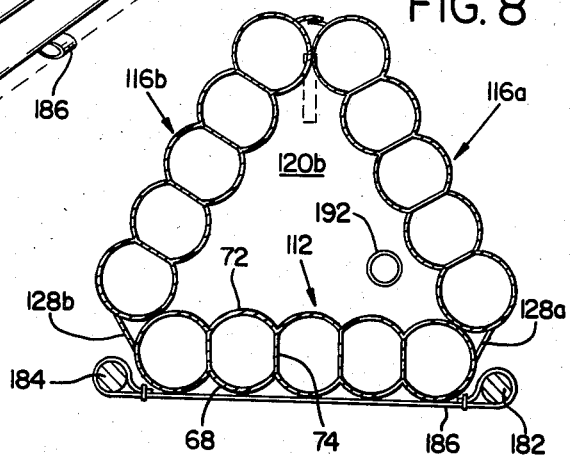

FIG. 8 is a sectional view taken along line 8—8 of FIG. 7, on an enlarged scale.

Figure 9:
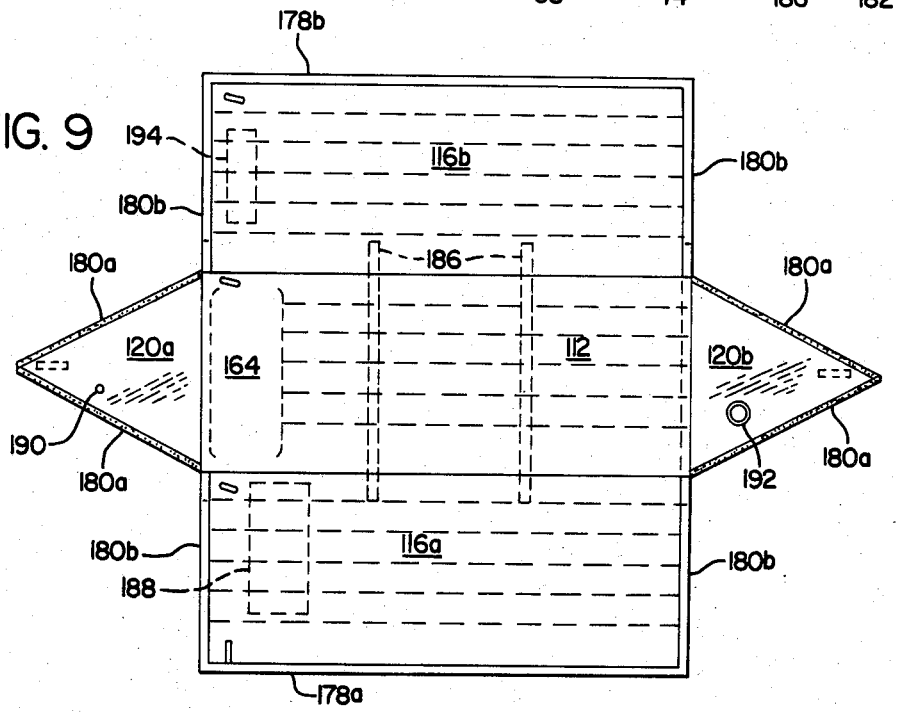

FIG. 9 is a plan view of the shelter of FIG. 6 in an "open" condition.

DETAILED DESCRIPTION OF A PREFERRED EMBODIMENT

Embodiment of FIGS. 1-5

A portable, inflatable shelter in accordance with the present invention includes an inflatable floor portion 12, inflatable side portions 16*a,b* and opposed end panels 20*a,b* which together cooperate to form an enclosed self-supporting shelter for one and possibly two persons. While the shelter can be sized to accommodate a greater number of persons, it is primarily intended to be a light, compact shelter suited for use by one or two persons in rugged, remote terrain.

The shelter is provided with a detachable cover 24 which slides over the full length of the tent. At the back end of the shelter the cover extends beyond the end of the shelter to provide a covered space for supplies and the like, and includes a drawstring for opening and closing this portion of the cover. The cover is preferably international orange in color to be clearly visible to ground or air rescue parties. While the cover provides some additional thermal insulation and protection against moisture, it is primarily intended to be easily washable to facilitate cleaning the shelter.

The side portions 16a,b comprise separate side panels that are connectably heat sealed at their upper edges to each other and at their lower edges to floor portion 12, using strips 28*a,b,c* of rubberized rayon or like material which extend virtually the full length of the shelter. Strips 28*a,b,c* cooperate with adjacent side/floor portions to create an air pocket along the seams where such portions meet to minimize heat loss at such seams. Similarly, the lower edge of each end panel 20*a,b* is connectably heat sealed to an end portion of floor portion 12, and in the case of end panel 20*b*, its side edges are heat sealed to side panels 16*a*, 16*b* as well. When inflated, the shelter has a substantially triangular configuration, with the side panels meeting one another at a seam which forms the apex of the shelter. The converging side edges of end panel 20*a* are secured to side panels 16*a*, 16*b* by fastening means, such as zippers 34, 36, to permit ingress to and egress from the shelter. With end panel 20*a* secured to side panels 16*a*, 16*b*, a completely enclosed shelter is provided.

End panel 20*a* is also provided with a ventilating means, such as a zipper 38, adjustable to permit a variable amount of ventilation from the ambient air into the shelter, thereby to control the temperature inside the shelter. Referring to FIG. 3, end panels 20*a*, 20*b* are made of a multi-layered material comprising outer layers 44, 48 of nylon or the like with a layer 52 of foam rubber therebetween. The end panels are quilted, as at 54, to permit greater heat loss than would otherwise occur.

Floor portion 12 and side portions 16*a*, 16*b* are separately inflatable by valve means 58, 60 and 62 (FIG. 4), respectively. In this way, the shelter is still functional if one of the floor or side portions springs a leak. Floor portion 12 is provided with a pillow portion 64 having its own valve means.

The construction of inflatable floor portion 12 and side portions 16*a,b*, which is the same, will now be described with reference to FIG. 5. Floor portion 12, as well as side portions 16*a,b*, are made of a rubberized rayon, PVC pregnated rayon or like material which is waterproof, tear resistant and able to withstand sub-zero temperatures without becoming brittle. It includes an outer wall 68 and inner wall 72. A plurality of parallel, continuous strips 74 of the same or similar material are connected at one end to outer wall 68 and at their other end to inner wall 72. They extend virtually the full length of the floor portion to divide the space between such walls into distinct air chambers or cells. The strips preferably terminate short of one or both ends of the floor portion to provide openings between the chambers so that they are pneumatically interconnected. The strips of the floor portion will necessarily be shorter than those of the side panels because they terminate at pillow portion 64.

Each strip 74 has an "I" shaped configuration including a central web portion and pair of leg portions 76*a,b* at each end. The leg portions are heat sealed to either the inner or outer wall. When inflated, the strips divide the space between the walls into a series of pneumatically interconnected air chambers, with the web portions extending substantially perpendicularly to the inner and outer walls. Moreover, the strips help support the inner and outer walls to make the floor portion relatively rigid and adapted to withstand considerable stress before deforming.

While the strips extend lengthwise of the shelter, it will be appreciated that they may extend perpendicularly thereto (transversely) or at some other orientation.

Embodiment of FIG. 6

Unlike the embodiment of FIGS. 1–5, the embodiment shown in FIG. 6 has side portions 16*c,d* which comprise part of a single member that bows to form an arch-like top above the floor portion when inflated.

Embodiment of FIGS. 7–9

The shelter shown in FIGS. 7–9 is identical to that shown in FIGS. 1–5, except where noted. Similar parts are given the same reference numeral as in FIGS. 1–5, but in the "100" series.

This embodiment includes a separately inflatable floor portion 112 and side panels 116*a*, 116*b*. It also includes opposed end panels 120*a*, 120*b* comprised of a multi-layered, non-inflatable material as previously described. The floor portion also includes a separately inflatable pillow portion 164. Alternatively, end panel 120*a* can be made of a translucent material, as shown in FIGS. 7 and 9, to allow one to visually monitor an occupant within the shelter. In that event, the shelter would not insulate against heat loss quite as efficiently as a shelter with a multi-layered end panel.

Unlike the embodiment of FIGS. 1–5, mating fastening means, such as Velcro strips 178*a,b* are provided at the upper edges of side panels 116*a* and 116*b* to detachably connect one to the other. Similarly, end panels 120*a*, 120*b* are detachably connected to side panels 116*a*, 116*b* by mating fastening means, such as Velcro strips 180*a,b*, secured to the end panels 120*a*, 120*b* and side panels 116*a*, 116*b*. In this way, the inflated shelter can be quickly and easily pulled apart to allow medical personnel access to an injured person transported within the shelter, without having to move such person from the floor portion upon which such person is supported. It is obviously desirable to keep any injured person as immobile as possible, particularly where there is a possibility of a neck or back injury.

The shelter is also provided with support receiving means secured to the underside of the floor portion to allow the shelter to be transported as a litter using a pair of poles 182, 184. The pole receiving means preferably includes several straps 186 which span the width of the floor portion and are "looped" at their ends to receive the poles.

A pouch 188 is sewn or otherwise fastened to side panel 116*a* to carry a portable oxygen cylinder. Oxygen from the cylinder is fed to the injured person within the shelter by a hose which passes through an opening 190 in end panel 120*a*. A similar but larger opening 192 is provided in end panel 120*b* to facilitate the hook-up of either a heating or air conditioning unit. In this way, the temperature in the shelter can be efficiently controlled depending on the circumstances. For example, if the injured victim is suffering from hypothermia, the temperature of the tent can be raised with a heating unit. Or, if the victim is suffering from heat stroke, the temperature in the shelter can be lowered using an air conditioning unit. A second pouch 194 is sewn or otherwise fastened to side panel 116 for carrying a repair kit or emergency supplies.

Operation

Each of the embodiments described has a substantial heat insulating capacity which allows it to be used under harsh weather conditions and for emergency use. The floor and side portions have a complete double wall construction which provides an air pocket between the inner and outer walls over their entire length to minimize heat loss to the environment. The shelter is so constructed as to eliminate any seams between adjacent air cells to significantly minimize heat loss and prevent moisture from entering the shelter.

The shelter, which has been tested in sub-zero temperatures, provides sufficient insulation such that the occupant's own body heat keeps the tent comfortably warm. In fact, it was discovered that the shelter insulates so well against heat loss that the end panels preferably should not be inflatable like the rest of the shelter to insure that the tent does not become uncomfortably warm. End panels of a quilted, multi-layered material, as described, work well because they provide insulation sufficient to make the shelter suitable for use under severe weather conditions, but not so great as to make the shelter uncomfortably warm under less severe conditions. The quilted stitching of the end panels allows them to breathe much more than they would otherwise. It has been roughly calculated that the percentage of the inflated surface area of the shelter is about 85–90%, with the balance of surface area attributable to the end panels.

The shelter is therefore suited for use under a wide variety of conditions. This characteristic is facilitated by the ventilating means in the forward end panel which enables one to control to some extent the ventilation in the shelter from the ambient air and hence the temperature in the tent.

The shelter is also virtually waterproof, thereby to keep its occupant(s) dry and much less prone to suffering from hypothermia. It does so by providing heat sealed connections at all the major adjoining edges of the various panels and by eliminating the moisture conducting seams of most prior tents.

Equally important, the shelter is provided with considerable structural support by virtue of the "I" shaped strips between the inner and outer walls of the various panels, enabling the shelter to withstand considerable stress due to high winds or heavy snowfall without buckling. It is able to substantially maintain its shape even when buried under two feet of snow.

The shelter is light (one man version weighs about 5 lbs.), portable, easy to set-up and self-supporting. It is ideally suited for use as emergency equipment in airplane crashes in rugged terrain where the danger of hypothermia exists. One or more shelters can be easily carried as standard equipment on small planes, or air dropped by airplane or helicopter to crash survivors if the crash site is known. It is not unusual for a ground search party to take at least several hours to reach a crash site even once the general location is known, or for bad weather to hamper or prevent a search party that has reached the crash site from evacuating the crash victims for several hours. The search party may even have to stay with the survivor(s) overnight before the evacuation takes place, making exposure a serious problem for all involved and particularly any injured victims. The present invention facilitates the survival of those concerned under the foregoing conditions.

While the embodiment of FIGS. 7–9 does not have quite the thermal insulating or waterproofing capacity of the embodiment of FIGS. 1–5, because of its detachably fastened edges, it affords substantial insulation and water resistance making it suitable for emergency use under most conditions, including cold weather. More importantly, this shelter affords substantial protection for an injured victim prior to and during evacuation, while allowing such victim to remain immobile during this time. Furthermore, once the victim is evacuated to safety, medical personnel have quick access to the victim simply by detaching the Velcro connections to "open" the shelter, again as such victim remains immobile. Finally, the shelter is provided with features that facilitate providing medical treatment to the victim during evacuation.

Having illustrated and described the principles of our invention with reference to one preferred embodiment, it should be apparent to those persons skilled in the art that such invention may be modified in arrangement and detail without departing from such principles. We claim as our invention all such modifications as come within the true spirit and scope of the following claims.

We claim:

1. A self-supporting, inflatable survival shelter comprising:

an inflatable floor portion of air impermeable material;

a pair of inflatable side portions of air impermeable material, said floor and side portions having a substantially triangular configuration when inflated;

a pair of opposed, quilted end portions of non-inflatable insulation material;

fastening means cooperable with one of said end portions and said side portions to permit opening and closing of said one end portion;

said floor and side portions each including:

an outer wall;

an inner wall; and a plurality of parallel, substantially I-shaped strips connected to said inner and outer walls, and extending substantially the entire length or width of said inner and outer walls, such that said inner and outer walls, when inflated, are spaced from one another and divided into a plurality of air-filled cells;

the shelter further including longitudinally extending strips connecting adjacent abutting cells of said floor and side portions, each said strip and associated cells cooperating to form a longitudinal insulating air pocket adjacent an interface between said abutting cells when inflated.

2. The shelter according to claim 1 wherein said insulation material is comprised of inner and outer layers of a rayon-like material and a foam rubber material therebetween.

3. The shelter according to claim 2 wherein said end panels are heat sealed along at least one edge to either said floor portion or one of said side portions.

4. The shelter according to claim 3 wherein one of said end portions includes adjustable ventilating means to control the amount of heat loss from the interior of the shelter to the outside environment.

5. The shelter according to claim 1 wherein the strips each and have a first leg portion secured to said outer wall, second leg portion secured to said inner wall and intermediate web portion extending substantially perpendicularly to said inner and outer walls.

6. The shelter according to claim 1 wherein said floor and side panel each include valve means for separately inflating the same.

7. The shelter according to claim 6 wherein said floor and side panels are made of a waterproof rubberized rayon or like material.

8. A shelter according to claim 1 including a detachable cover open at one end and sized to snugly fit over said floor and side panels.

9. An emergency inflatable shelter comprising:

opposed, non-inflatable end panels and inflatable floor and side portions cooperable to form an enclosed, self-supporting shelter;

said floor and side portions each including:

an outer wall;

an inner wall;

a plurality of substantially, parallel strips connected to said inner and outer walls, and extending substantially the entire length or width of said inner and outer walls, to space said walls from each other and divide the space therebetween into a plurality of pneumatically connected cells;

said floor and side portions being attached to said end panels; and fastening means associated with said side and end panels for detachably fastening selected edges thereof to each other, thereby to permit said floor, side and end panels to be unfolded into a substantially planar configuration, each said side portion being connected to said floor portion by a longitudinal strip such that when said floor and side portions are in an abutting inflated relationship, the strip cooperates with said floor and said side portions to form a thermally insulating air pocket along an interface thereof, whereby an injured victim can be laid on said floor panel and transported in an enclosee, controlled environment and yet remain easily accessible for treatment without having to be moved from said floor panel.

10. The shelter according to claim 9 wherein said floor panel includes support receiving means to allow the shelter to be transported as a litter.

11. The shelter according to claim 9 wherein said fastening means includes mating strips of Velcro material.

12. The shelter according to claim 9 including means defining an opening in one of said end panels to provide access for an oxygen hose or the like.

13. A self-supporting, inflatable shelter comprising:

an inflatable floor portion of air impermeable material;

a pair of opposed, quilted end portions of non-inflatable insulation material;

an arcuate, inflatable supported wall portion connecting said end portions;

fastening means cooperable with one of said end portions and said wall portion to permit opening and closing of said one end portion;

said floor and wall portions each including:

an outer wall;

an inner wall; and a plurality of substantially parallel, strips connected to said inner and outer walls, and extending substantially the entire length or width of said inner and outer walls, such that said inner and outer walls, when inflated, are spaced from one another and divided into a plurality of air-filled cells;

the shelter further including longitudinally extending strips connecting adjacent abutting cells of said floor portion and said wall portion, each said strip and associated cells cooperating to form a longitudinal insulating air pocket adjacent an interface between said abutting cells when inflated.

* * * * *